US008959851B1

(12) United States Patent
Cardinal

(10) Patent No.: US 8,959,851 B1
(45) Date of Patent: Feb. 24, 2015

(54) MANUFACTURES, METHODS AND STRUCTURES TO REDUCE ENERGY TRANSFER IN BUILDINGS

(71) Applicant: Alcoa Inc., Pittsburgh, PA (US)

(72) Inventor: Keith Cardinal, Zelienople, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 14/025,256

(22) Filed: Sep. 12, 2013

(51) Int. Cl.
*E06B 7/14* (2006.01)
*E06B 1/36* (2006.01)
*E06B 1/32* (2006.01)

(52) U.S. Cl.
CPC .... *E06B 1/36* (2013.01); *E06B 1/32* (2013.01)
USPC ..... 52/209; 49/489.1; 49/492.1

(58) Field of Classification Search
CPC ..... E06B 3/00; E06B 3/12; E06B 3/20; E06B 3/263; E06B 3/26341; E06B 3/54; E06B 2003/4469; B60J 10/02; B60J 10/04
USPC ..... 52/204.5, 204.51, 204.62, 204.69, 52/204.7, 209, 489.1, 492.1, 495.1; 49/489.1, 492.1, 495.1
See application file for complete search history.

(56) References Cited

U.S. PATENT DOCUMENTS

| | | | | |
|---|---|---|---|---|
| 2,872,713 | A * | 2/1959 | Haas | 52/172 |
| 6,334,283 | B1 * | 1/2002 | Edger | 52/204.1 |
| 2008/0196342 | A1 * | 8/2008 | Franklin | 52/309.1 |
| 2011/0296776 | A1 * | 12/2011 | Valler et al. | 52/204.6 |

OTHER PUBLICATIONS

Storefront and Curtain Wall GLASSvent™ Windows brochure, Kawneer, An Alcoa Company EC-97911-21, Sep. 2010, 12 pages.

* cited by examiner

*Primary Examiner* — William Gilbert
(74) *Attorney, Agent, or Firm* — Greenberg Traurig, LLP

(57) ABSTRACT

A manufacture for reducing thermal transfer through windows has a composite metal/nonmetallic frame and/or a composite vent surround. The metallic and non-metallic components are modular and selectively coupled, such that a range of variations to accommodate different applications may be inter-coupled via common interfaces.

20 Claims, 6 Drawing Sheets

MANUFACTURES, METHODS AND STRUCTURES TO REDUCE ENERGY TRANSFER IN BUILDINGS

FIELD

The present invention relates to building products and more particularly, to windows and window frames.

BACKGROUND

Some windows utilize vent surrounds and frames made from metal, e.g., aluminum alloy. Metal windows are in use in residential and commercial buildings, e.g., in storefronts and in curtain walls used on the façade of high-rise buildings. The energy transfer characteristics of windows are an important factor in the overall energy efficiency of a building and there is a continual search for building features and methods of construction that improve energy efficiency. Improved and/or alternative structures and methods for controlling the heat transfer characteristics of windows remain desirable.

SUMMARY

The disclosed subject matter relates to an access structure for an opening through a building envelope, including a frame structure coupled to the building, framing the opening and a spanning element spanning the frame structure, at least partially covering the opening. The spanning element has at least one panel and a surround embracing the periphery of the panel, the frame structure having a parallel portion extending parallel to the spanning element in a spanning direction and a perpendicular portion extending perpendicular to the spanning element relative to a spanning direction. At least one of the perpendicular portion of the frame structure and the surround being a composite of a metal portion and a non-metal portion, the non-metal portion having a lower thermal conductivity than the metal portion, the non-metal portion being exposed to a first environment on a first side of the building envelope and the metal portion being proximate a second environment on a second side of the building envelope.

In one approach, the access structure is a window providing access to light and the at least one panel is a glazing panel.

In one approach, the window has an opened and a closed position.

In one approach, the surround includes a box portion made from metal and the perpendicular portion includes a non-metallic ledge that attaches to the box portion.

In one approach, the box portion has an elongated channel and the non-metallic ledge has an L-shaped cross-sectional shape, the ledge having an insertion leg capable of being received in the elongated channel and forming a portion of the L-shape.

In one approach, the ledge has at least one finger extending therefrom in a direction opposite to the insertion leg for reducing airflow proximate the ledge.

In one approach, the insertion leg has a plurality of burrs having a directionality that promotes insertion of the insertion leg into the channel and opposes withdrawal therefrom.

In one approach, the ledge has a front-to-back slope capable of promoting water runoff.

In one approach, the ledge has a plateau at the base of the insertion leg that mates with a mating recess communicating with the channel to establish a given relative orientation.

In one approach, the perpendicular portion of the frame has a connection bead that is capable of snap-fitting to an adaptor, the adaptor being non-metallic.

In one approach, the adaptor, when in place on the connection bead is proximate at least one seal extending from the surround when the spanning element at least partially covers the opening.

In one approach, the connection bead has a bifurcated arrowhead cross-sectional shape having a pair of opposed lead-in surfaces that interact with corresponding sloped surfaces on opposed arms of the adaptor, which define a hollow there between having a shape complementary to the connection bead, the arms resiliently displacing when pushed against the lead-in surfaces and snapping to a closed position when pushed beyond the lead-in surfaces.

In one approach, the arrowhead cross-sectional shape has a recess at the tip to receive sealant.

In one approach, the window is fixed.

In one approach, the access structure is a door.

In one approach, the at least one of the composite frame structure and surround are composite via an interlocking interface, such that a plurality of interchangeable parts may be attached at the interface giving rise to modularity supporting use of the access structure for a plurality of different applications.

In one approach, both the frame structure and the surround are composite.

In one approach, the metal portion is formed from an aluminum alloy and the non-metallic portion is formed from a polymer.

In one approach, the first environment is the out-of-doors and the second environment is interior to the building envelope.

In one approach, both the frame structure and the surround are formed from a plurality of elongated elements attached together at the ends thereof.

In one approach, the adaptor has a raceway distal to the opposed arms for receiving a trim cover.

In one approach, a method for assembling a window for an opening through a building envelope, includes obtaining a plurality of elongated frame elements made from aluminum alloy extrusions and attaching them together at the ends thereof to form a frame structure; obtaining a plurality of elongated box sections made from aluminum alloy extrusions and having an outward facing channel; attaching the plurality of elongated box sections together at the ends thereof to form a first portion of a window surround; obtaining a glazing panel; obtaining a plurality of L-shaped ledge portions made from polymer and having insertion legs; inserting the insertion legs of the ledge portions into corresponding channels of the box sections to form a surround capable of embracing the periphery of the glazing panel and inserting the glazing panel into the surround to form a vent assembly; attaching the frame structure to the building, framing the opening; and attaching the vent assembly to the frame structure.

In one approach, a method for assembling a window for an opening through a building envelope, includes obtaining a plurality of elongated frame elements made from aluminum alloy extrusions and having an attachment bead disposed on a surface thereof; attaching the elongated frame elements together at the ends thereof to form a frame structure; obtaining a plurality of polymer adaptors having a coupling head; attaching the adaptors to corresponding ones of the frame elements by snap-fitting the coupling head over the attachment bead to form a frame assembly; obtaining a plurality of elongated vent surround sections made from aluminum alloy extrusions; attaching the plurality of elongated vent surround sections together at the ends thereof to form a vent surround; obtaining a glazing panel; inserting the glazing panel into the vent surround to form a vent assembly; attaching the frame structure to the building, framing the opening; and attaching the vent assembly to the frame structure.

In one approach, a vent surround, includes a box portion made from a plurality of metal sub-sections connected at the ends thereof and a non-metallic ledge with a plurality of sub-sections that attach to the sub-sections of the box portion, the sub-sections of the box portion each having an elongated channel and each of the sub-sections of the non-metallic ledge having an L-shaped cross-sectional shape with an insertion leg capable of being received in the elongated channel, the non-metallic ledge having a lower thermal conductivity than the metal box portion, the non-metallic ledge being proximate a first environment on a first side of the building envelope and the metal box portion being proximate a second environment on a second side of the building envelope.

In one approach, a frame structure couplable to a building to frame an opening through the building envelope includes a metallic base portion that couples to the building; a metallic extension portion extending perpendicular to the building envelope proximate the opening; a non-metallic adaptor capable of being coupled to the extension portion, the non-metallic adaptor having a lower thermal conductivity and position proximate a first environment on an exterior of the building envelope and the metallic base and extension portions having a higher thermal conductivity and positioned proximate a second environment on the interior of the building envelope.

BRIEF DESCRIPTION OF THE DRAWINGS

For a more complete understanding of the present disclosure, reference is made to the following detailed description of exemplary embodiments considered in conjunction with the accompanying drawings.

DETAILED DESCRIPTION OF EXEMPLARY EMBODIMENTS

Figure 1:
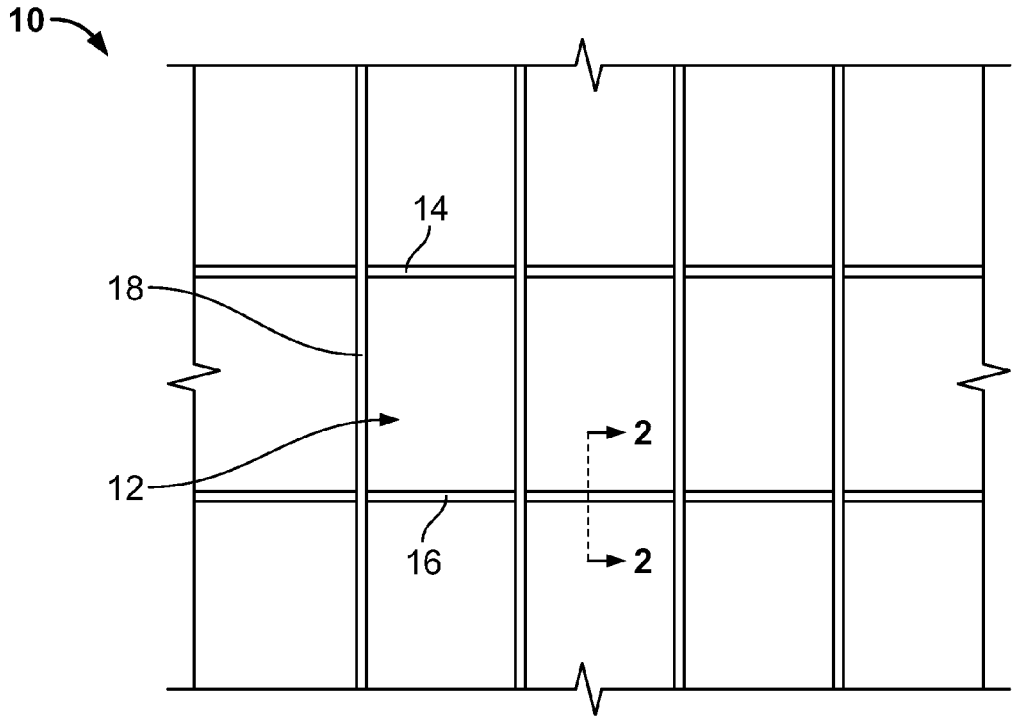
FIG. 1 is elevational view of a fragment of a window system.

FIG. 1 shows a window system 10, e.g., for a façade of a commercial building, such as a multi-story high rise building. Using conventional terminology, each window unit 12 of the window system 10 has a head 14, a sill 16 and jambs 18. The jambs 18 between adjacent window units 12 may be designated mullions. Some or all of the window units 12 may be hinged to be opened and closed for ventilation. For applications where there is no protective roof or awning overhang, the window unit would typically open at the sill 16. In other applications, the window units 12 may open at the head 14 or at the jambs 18.

Figure 2:
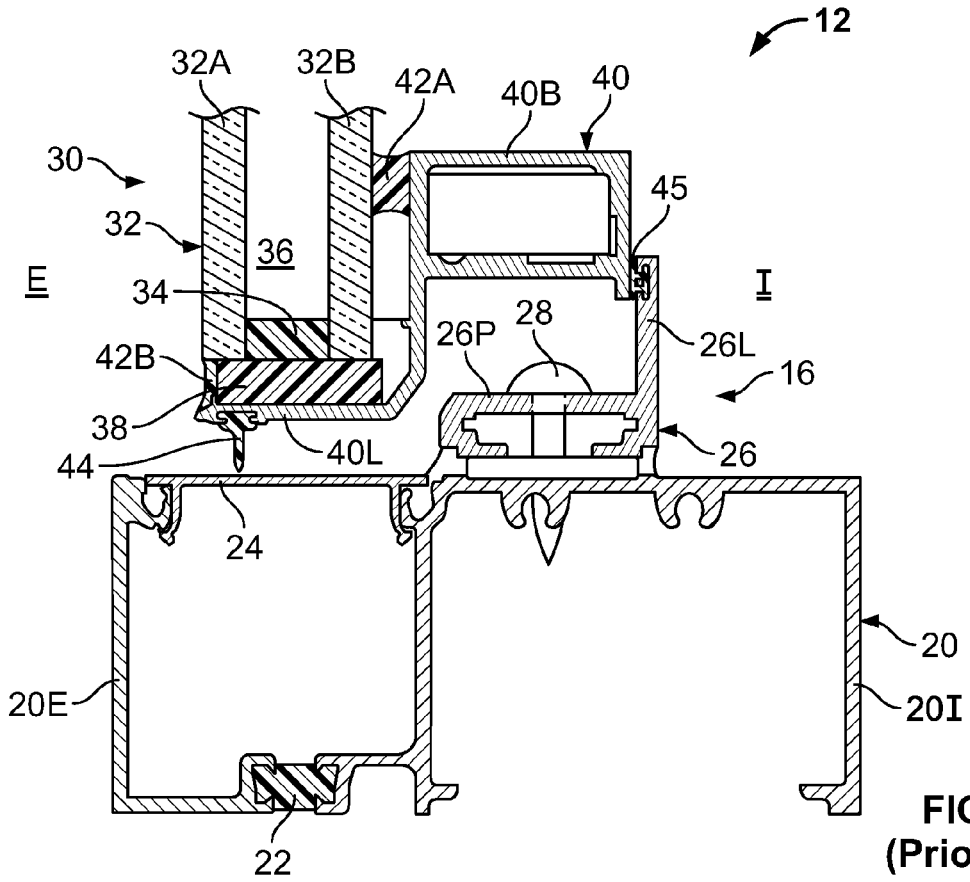
FIG. 2 (Prior Art)
FIG. 2 is a cross-sectional view of a sill of the window system of FIG. 1 taken along section line 2-2 and looking in the direction of the arrows.

FIG. 2 is a cross-sectional view of a window unit 12 of FIG. 1 at the sill 16 in accordance with the prior art. A compound structural beam 20 having an interior portion 20I and an exterior portion 20E separated by a thermal break 22 and bridged by a plate 24 is a component of the building structure, e.g., a storefront. The beam 20 is attached to the superstructure of the building and serves as the mounting surface for a window frame element 26, which may be fastened to the beam 20 by screws 28 or other fasteners extending through a peripheral portion 26P. A plurality of attached frame elements 26, e.g., four (at the head, sill and jambs) may be used to define a rectangular frame for the window unit 12. The frame elements 26 may be L shape in cross section, a limiting portion 26L limiting the motion of a vent 30 in the direction of the interior I. The vent 30 is the portion of the window unit 12 that typically contains an optically transparent/translucent glazing unit 32, e.g., one or more (e.g., double or triple glazed windows) glass or plastic panels 32A, 32B separated by an intermediate spacer 34, defining a space 36, which may contain air, an inert gas or radiation/convection barrier films. A peripheral setting block 38 is attached to the edge of the panels 32A, 32B to protect glazing unit 32 from being damaged by direct contact with vent surround ledge portion 40L. The vent surround 40 may be made from a plurality of extrusions that are coupled together to embrace the glazing unit 32 at all sides thereof, e.g., four sides for rectangular glazing panels 32A, 32B. For example, the vent surround 40 may be formed from four aluminum alloy extrusions that are miter cut at the ends thereof and then assembled, by welding, staking and/or with brackets and/or fasteners. The vent surround 40 may have a boxed portion 40B to impart structural rigidity and an integrally formed ledge portion 40L that surrounds the glazing unit 32. The glazing unit 32 may be secured to the vent surround 40 by the use of a silicone sealant 42A, 42B.

A first seal 44, which may be formed from an elastomer is attached to the vent surround 40 and reduces weather infiltration between the window frame elements 26 and the vent surround 40. A second seal 45 attached either to the frame elements 26 or the vent surround 40 (but not both) may aid in preventing weather intrusion into the interior I. The seals 44 and 45 allow the vent surround 40 to be moved relative to the frame elements 26, such that the window unit 12 may be opened and closed, while decreasing weather (air and water) infiltration.

An aspect of the present disclosure is the recognition that the vent surround 40 is a conduit for heat transfer from the environment E exterior to the window unit 12 to an environment I interior to the window unit 12 (inside a building).

Figure 3:
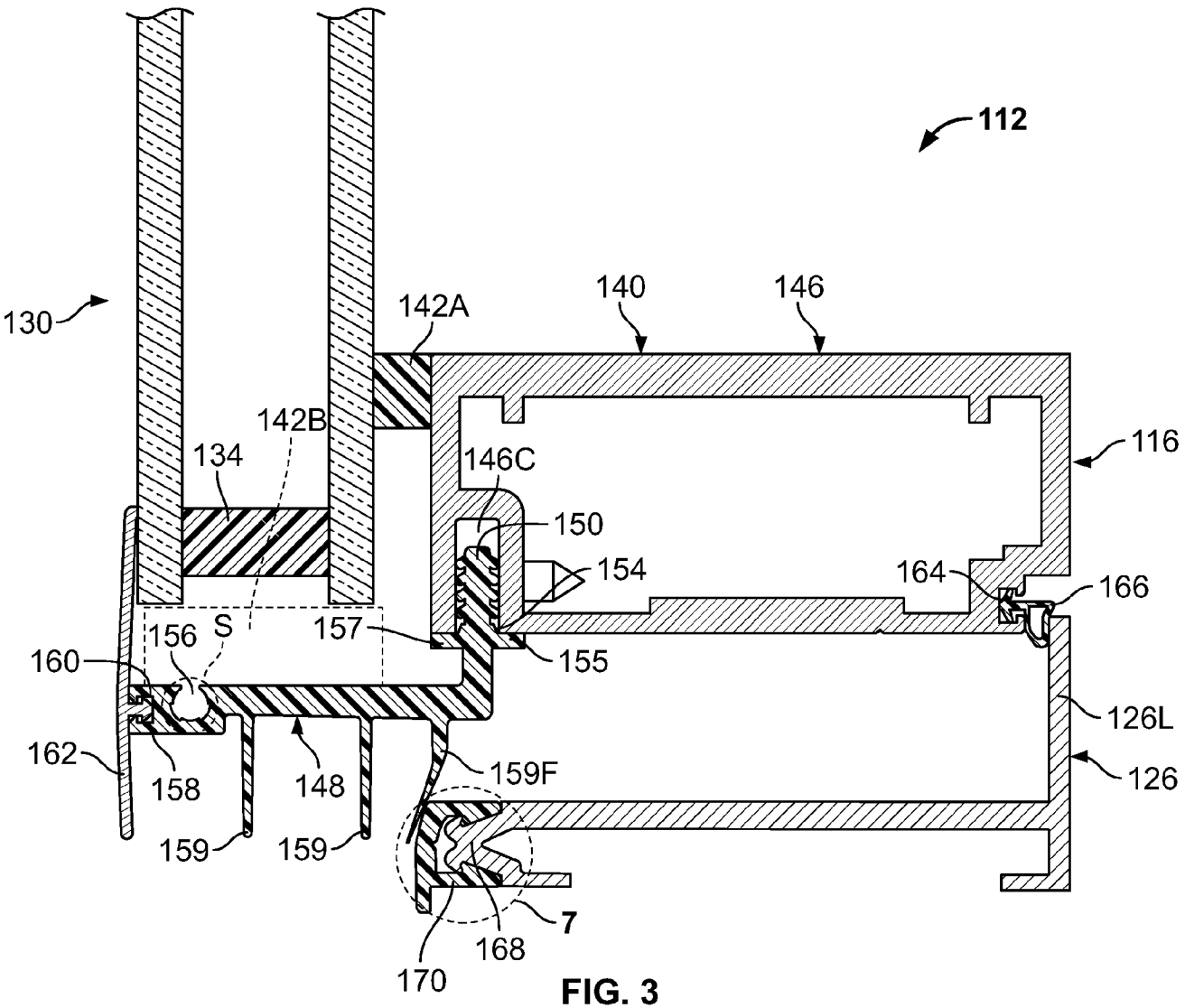
FIG. 3 is a cross-section like FIG. 2, but of a window system in accordance with an embodiment of the present disclosure.

FIG. 3 is a cross-section of a window unit 112 in the sill 116 area like the window unit 12 of FIG. 2, but in accordance with an embodiment of the present disclosure. The window unit 112 features a composite vent surround 140 featuring a boxed portion 146 made, e.g., from aluminum alloy to impart structural rigidity, and an independently formed ledge portion 148 made, e.g., from a polymer, such as rigid PVC or glass reinforced nylon, having a lower heat conductivity than aluminum. Ledge portion 148 has an insertion leg 150 which may have a plurality of engagement ribs/barbs 152 (See FIGS. 4 and 5) that are disposed at an angle B relative to the insertion leg 150, the angle facilitating insertion into and resisting removal from a channel 146C in the box section 146. The insertion leg 150 may be retained in the slot 146C by friction fit, the action of the ribs/barbs 152 and/or an adhesive. As in the window unit 12 described above, a plurality, e.g., four, vent surrounds 140 with associated box portions 146 and ledge portion 148 may be assembled together to surround and retain the glazing unit 130. The aluminum alloy boxed portions 146 may be connected by welding, brackets and fasteners, etc., thereby forming a rigid framework for mounting the ledge portions 148, which may also be attached together, e.g., by screws or rivets. The glazing unit 130 may be adhered to the box section 146 by a sealant 142A and the window unit may also feature a a peripheral setting block 142B (shown in dashed lines tofor eas of illustration).

Figure 4:
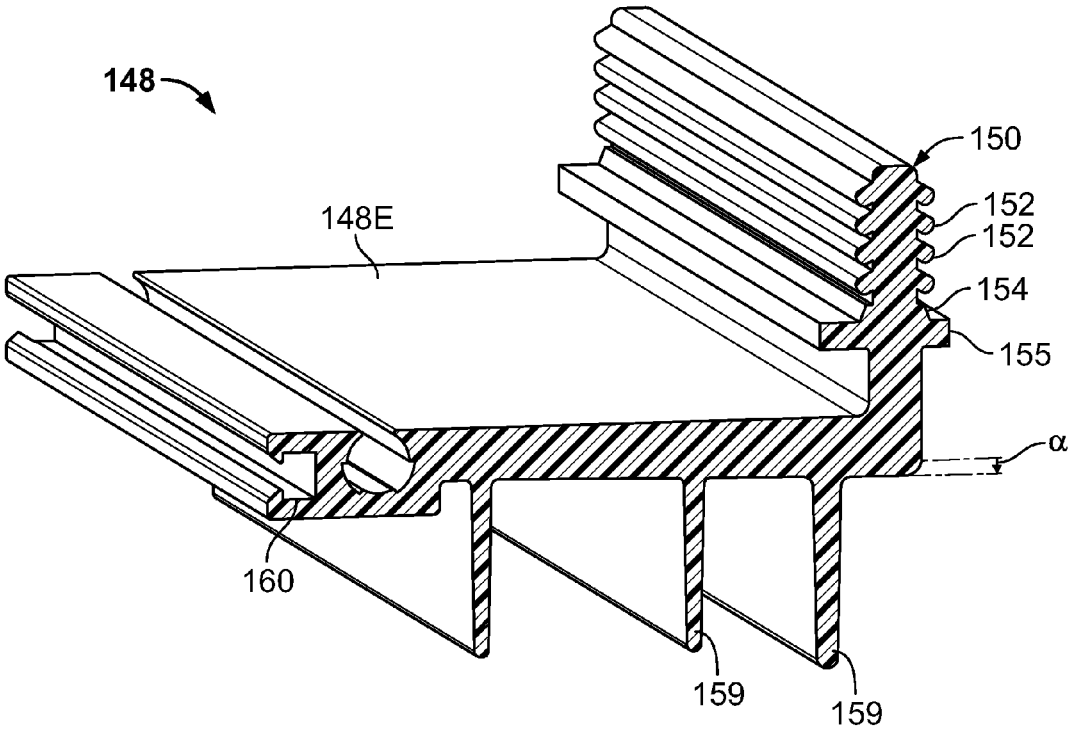
FIG. 4 is a perspective view of a ledge portion of a vent surround.
Figure 5:
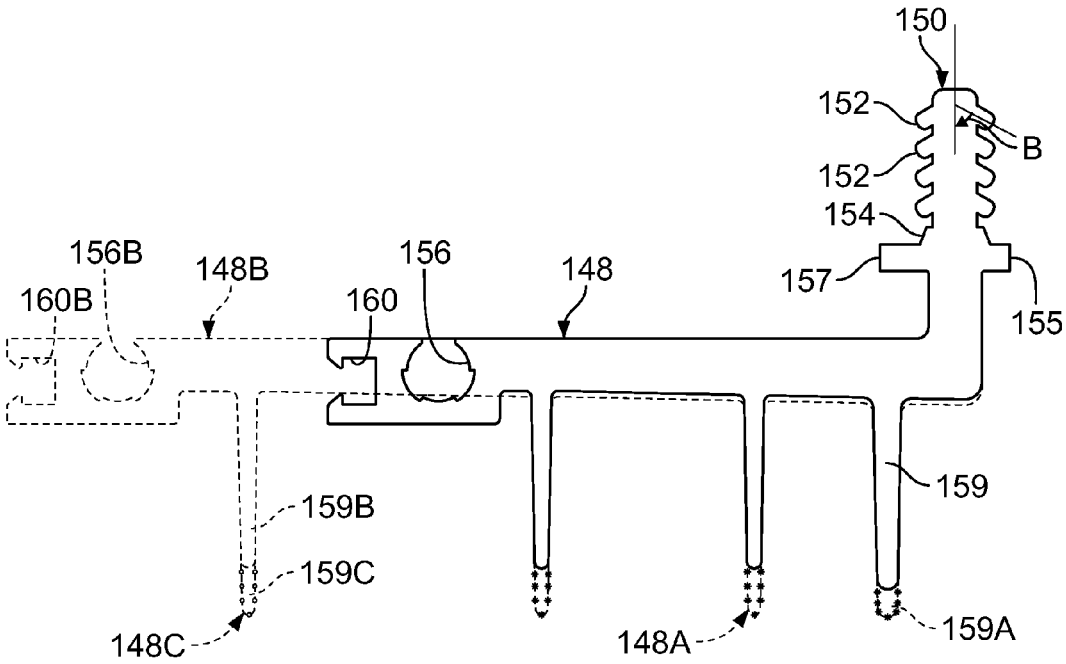
FIG. 5 is a side view of the ledge portion of FIG. 4 and alternative ledge portions.

FIGS. 3, 4 and 5 shows that the ledge portion 148 may be provided with a self-centering plateau 154 that matingly engages corresponding surfaces of the channel 146C to automatically establish a pre-selected relative orientation between the ledge portion 148 and the box portion 146. A hinge hardware locating nub 155 provides a reference surface for uniform and precise hinge hardware positioning when hinges are used and acts in conjunction with insertion stop 157 to limit insertion and stabilize the ledge portion 148 relative to the box portion 146. The ledge portion 148 has a plurality of thermal barrier fingers 159 made, e.g., from high durometer, soft PVC or other flexible materials, that may bear against or pass close to an opposing surface to reduce the passage of air and consequent transfer of energy. As explained more fully below, the window unit 112 embodiment shown in FIG. 3 features a composite frame element 126 with a bifurcated coupling bead or barb 168 upon which a frame extension/adaptor 170 may be received and retained. The adaptor 170 abuts against (and displaces) the first finger 159F to effect a weather seal. The fingers 159 may be spaced to minimize thermal conduction, as explained further below.

The ledge portion 148, which may be considered a first ledge portion 148, has an integrated screw port 156 for receiving screws S (one screw head shown diagrammatically in dotted lines) extending through an adjacent second ledge portion 148 to hold the adjacent second ledge portion to a first ledge portion 148 via a screw screwed through the second ledge portion and extending into the screw port 156. For example, if a first ledge portion 148 (as depicted in FIG. 3) is disposed along the sill then a second ledge portion 148 disposed along the adjacent jamb may be tightly attached to the sill ledge portion 148 via a screw that extends through the jamb ledge portion 148 and into the screwport 156 of the sill ledge portion 148. A flat offset area 158 allows the first and second ledge portions 148 to seat flush to one another and defines a ledge that prevents relative translational movement when the screw S is tightened.

An integral raceway 160 accommodates a variety of trim covers 162 or other modular parts in snap-fit relationship. The trim cover 162 covers the adjacent edge of the glazing unit 130 and also extends down to reduce weather infiltration. The box section 140 also features a raceway 164 for receiving a bead seal 166 that seals against limiting portion 126L of window frame element 126. The frame element 126 has a bifurcated coupling bead 168 at an end thereof for coupling to a selected adaptor 170, as described more fully below. The adapter 170 may be selected to interact advantageously with a given window unit installation environment (to reduce heat transfer/weather infiltration) and also to accommodate different types of glazing units 130, e.g., double and triple glazed. FIG. 4 shows that the ledge 148 may have a surface 148S from which the fingers 159 extend with a front-to-back taper angle alpha of e.g., 1 degree. The taper angle may be used to shed water away from the window unit 112 when the ledge portion is used at the head 14, i.e., with the fingers 159 pointed up. Alternatively, the extending portion 148E may be molded at an angle less than 90 degrees relative to the insertion leg 150.

FIG. 5 shows that different ledge portions 148, 148A, 148B, 148C with different dimensions and number of fingers 159, 159A, 159B, 159C may utilize the same features, e.g., insertion leg 150, plateau 154, hinge nub 155 and insertion stop 157, that allow coupling the ledge portions 148, 148A, etc. to the same type of box portion 146. In a similar manner, the box portion 146 may be varied in dimensions but have a consistently shaped and dimensioned channel 146C that may couple in a consistent manner to one or more different ledge portions 148. The consistent coupling features lead to modularity, i.e., multiple parts with variations optionally coupling to multiple parts with variations, in the same manner. Ledge portion 148 with fingers 159 (all in solid lines) is an example of a ledge portion 148 that may be suitable for use with a double glazed glazing unit 130 used in a storefront application. The dimensions of ledge portion 148 may be varied, e.g., to be suitable for use in a curtain wall application by extending the length of fingers 159A, yielding a variant ledge portion 148A. Ledge portion 148B with fingers 159B (in dashed lines) may be suitable for a triple glazed storefront window. For a curtain wall application, the fingers 159B can be lengthened, as shown by 159C to yield a variant ledge portion 148C. Notwithstanding the variations in dimensions of the ledge portions 148, 148A, 148B, the tooling used to process an elongated extrusion, e.g., eighteen feet in length, into assemblable portions of a given length for surrounding a given glazing unit 130, may remain consistent. For example, a cutter (not shown) used to remove a length, e.g., 4.25 to 5.0 inches of the insertion leg 150 at either end of the horizontal lengths of the ledge portion 148 to permit mating with the vertical lengths, may be the same for each variant of the ledge portions 148A, 148B and 148C. Similarly, tools for miter cutting, punching or drilling the holes for passing screws S, etc. may be standardized for a variety of ledge portions with different dimensions.

Figure 6:
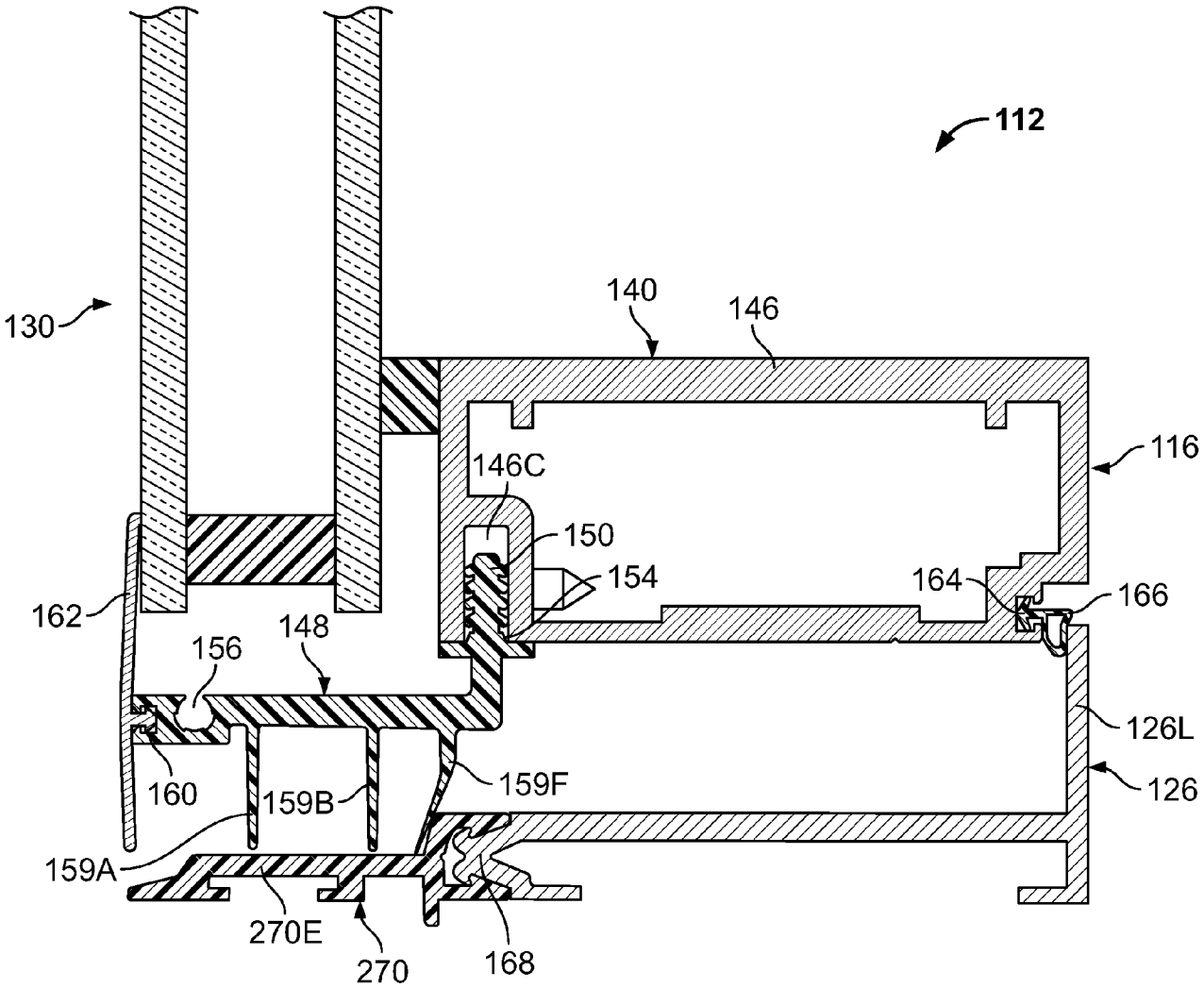
FIG. 6 is a cross-section like FIG. 2, but of a window system in accordance with another embodiment of the present disclosure.

FIG. 6 is a cross-section of a window unit 112 in the sill 116 area like the window unit 12 of FIG. 3, but with a different type of adaptor 270. As before, the window unit 112 features a composite vent surround 140 featuring a boxed portion 146 made, e.g., from aluminum alloy to impart structural rigidity, and an independently formed ledge portion 148 made, e.g., from a polymer, such as rigid PVC or glass reinforced nylon, having a lower heat conductivity than aluminum. The composite frame element 126 has a bifurcated coupling bead or barb 168 upon which a frame extension/adaptor 270 may be received and retained. The adaptor 270 is made from a polymer, such as rigid PVC or glass reinforced nylon, having a lower heat conductivity than aluminum and abuts against (and displaces) the first finger 159F to create a weather seal. An extension portion 270E extends below and proximate to the ends of fingers 159A, 159B and trim cover 162 to further improve weather resistance. Optionally, the fingers 159A, 159B may contact the extension 270E.

Figure 7:
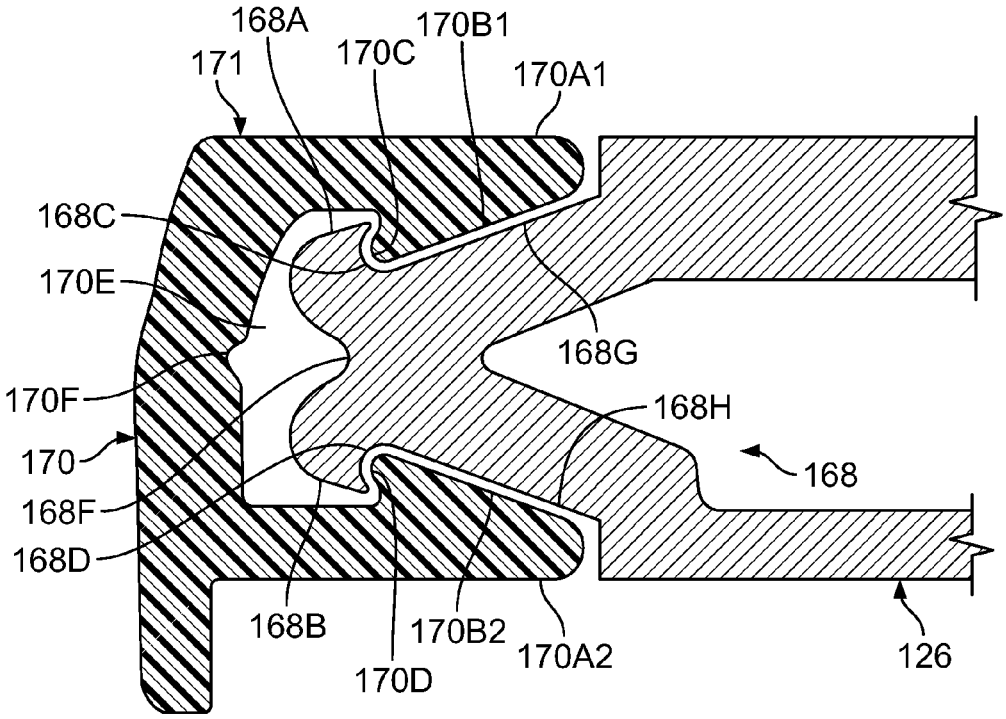
FIG. 7 is an enlarged portion of FIG. 3.

FIG. 7 shows the coupling bead/barb 168 with dual lead-in surfaces 168A, 168B that meet negatively cambered surfaces 168C, 168D at a cusp or point. The adaptor 170 has a coupling portion 171 having a pair of opposed arms 170A1 and 170A2 with complementary, mating surfaces, viz., sloped lead-in surfaces 170B1, 170B2 that meet positively cambered surfaces 170C, 170D at a rounded point. The lead-in surfaces 168A, 168B and 170B1, 170B2 facilitate inserting the barb 168 into the cavity 170E of the coupling portion 171, the adaptor 170 resiliently bending and then snapping back into a rest configuration when the barb 168 is fully inserted into the cavity 170E in the engaged position. When in the engaged position, the surfaces 168C, 168D and mating surfaces 170C, 170D hinder dis-engagement and ensure a positive locking interaction with minimal rotation. Central recesses 168F and 170F accommodate a bead sealant (not shown) that is applied prior to assembly to aid in preventing water infiltration. Surfaces 170B1, 170B2 closely parallel surfaces 168G, 168H when the adaptor 170 is coupled to the coupling bead 168 to aid in sealing the coupled adaptor 170 and coupling bead 168.

Figure 8:
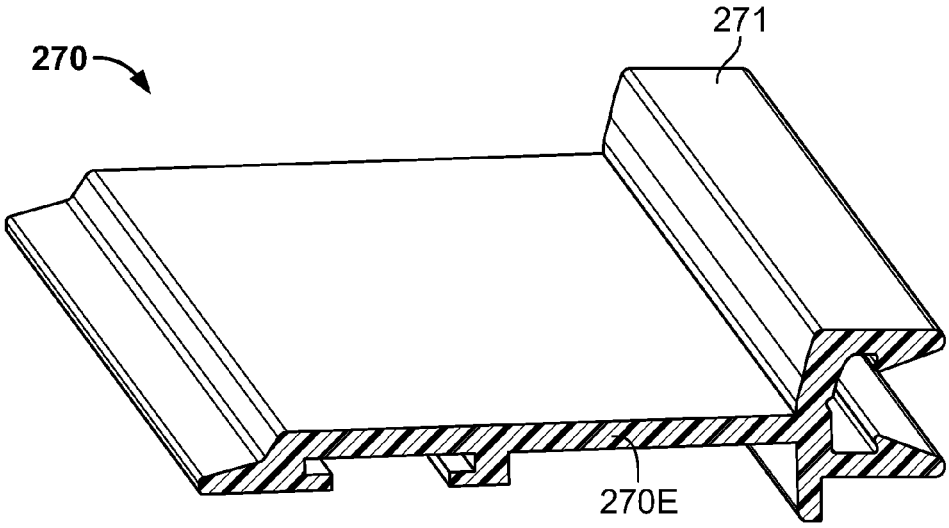
FIG. 8 is a perspective view of a frame adaptor in accordance with another embodiment of the present disclosure.

FIG. 8 shows the adaptor 270 of FIG. 6 prior to connection to a coupling bead 168 of window frame element 126. An extension portion 270E extends from coupling portion 271.

Figure 9:
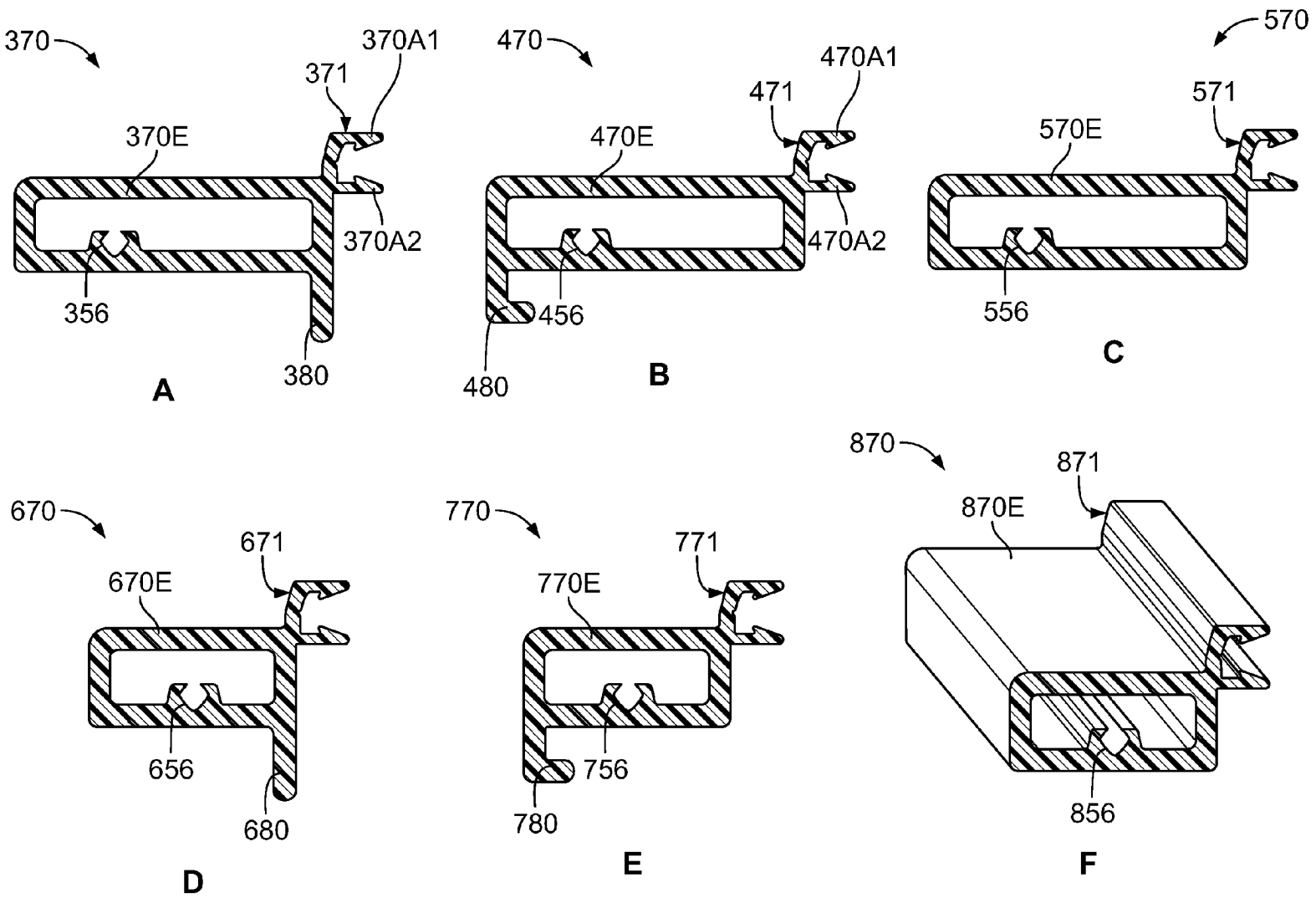
FIG. 9 is a series of cross-sectional views of frame adaptors in accordance with embodiments of the present disclosure.

FIGS. 9A-9F show a series of frame adaptors 370, 470, 570, 670, 770, 870, e.g., that may be used in the context of a curtain wall window system. FIG. 9F shows a perspective view of the frame adaptor 870. The adaptors 370, 470, 570, 670, 770, 870 are varied in dimensions and have various extensions, e.g., 370E, 470E, 570E, 670E, 770E, 870E with different dimensions and features, e.g., the positioning of the screw ports 356-856 and wings 380, 480, 680, 780, but have a common configuration with respect to coupling portion 371, 471, 571, etc., which have coupling arms, e.g., 370A1, 370A2, 470A1, 470A2, allowing the different adaptors to be attached to the same types of coupling bead 168 (FIG. 7).

While the foregoing describes composite vent surrounds 140 and composite window frames 126 with metal and plastic components explained relative to use in a sill 116, the head 14, and jambs 18 may be similarly formed from composite elements to reduce heat transfer and weather infiltration.

It will be understood that the embodiments described herein are merely exemplary and that a person skilled in the art may make many variations and modifications without departing from the spirit and scope of the claimed subject matter. For example, while the present disclosure has been expressed relative to windows, the disclosed concepts could be applied to doors, non-window vents and other building structures. All such variations and modifications are intended to be included within the scope of the appended claims.

I claim:

1. An access structure for an opening through a building envelope, comprising:

a frame structure coupled to the building, framing the opening, the frame structure having a plurality of elongated frame elements made from aluminum alloy extrusions with an attachment bead disposed on a surface thereof, the elongated frame elements attached together at the ends thereof to form the frame structure;

a plurality of polymer adaptors having a coupling head, each of the plurality of adaptors attached to corresponding ones of the frame elements by snap-fitting the coupling head to the attachment bead to form a frame assembly;

a vent assembly spanning the frame structure, at least partially covering the opening, the vent assembly having at least one glazing panel and a panel surround embracing the periphery of the glazing panel, the panel surround having a plurality of elongated panel surround sections made from aluminum alloy extrusions, the plurality of elongated panel surround sections attaching together at the ends thereof to form the panel surround, the glazing panel being inserted into the panel surround to form the vent assembly, the vent assembly being attached to the frame structure.

2. The access structure of claim 1, wherein the access structure is a window providing access to light and the at least one panel is a glazing panel.

3. The access structure of claim 2, wherein the window is fixed.

4. The access structure of claim 2, wherein the window has an opened and a closed position.

5. The access structure of claim 4, wherein each of the plurality of elongated panel surround sections includes a box portion made from metal and a non-metallic ledge that attaches to the box portion.

6. The access structure of claim 5, wherein the box portion has an elongated channel and the non-metallic ledge has an L-shaped cross-sectional shape, the ledge having an insertion leg capable of being received in the elongated channel and forming a portion of the L-shape.

7. The access structure of claim 6, wherein the ledge has at least one finger extending therefrom in a direction opposite to the insertion leg for reducing airflow proximate the ledge.

8. The access structure of claim 6, wherein the insertion leg has a plurality of burrs having a directionality that promotes insertion of the insertion leg into the channel and opposes withdrawal therefrom.

9. The access structure of claim 6, wherein the ledge has a front-to-back slope capable of promoting water runoff.

10. The access structure of claim 1, wherein the polymer adaptors, when in place on the connection bead are proximate at least one seal extending from the panel surround when the vent assembly at least partially covers the opening.

11. The access structure of claim 1, wherein the access structure is a door.

12. The access structure of claim 1, wherein the at least one of the frame structure and panel surround are composite via an interlocking interface, such that a plurality of interchangeable parts may be attached at the interface giving rise to modularity supporting use of the access structure for a plurality of different applications.

13. The access structure of claim 1, wherein both the frame structure and the panel surround are composite.

14. The access structure of claim 1, wherein the building envelope defines a first environment that is the out-of-doors and the second environment that is interior to the building envelope.

15. An access structure for an opening through a building envelope, comprising:

a frame structure coupled to the building, framing the opening;

a spanning element spanning the frame structure, at least partially covering the opening, the spanning element having at least one panel and a surround embracing the periphery of the panel, the frame structure having a parallel portion extending parallel to the spanning element in a spanning direction and a perpendicular portion extending perpendicular to the spanning element relative to a spanning direction;

at least one of the perpendicular portion of the frame structure and the surround being a composite of a metal portion and a non-metal portion, the non-metal portion having a lower thermal conductivity than the metal portion, the non-metal portion being exposed to a first environment on a first side of the building envelope and the metal portion being proximate a second environment on a second side of the building envelope, the access structure being a window providing access to light, having an opened and a closed position and the at least one panel being a glazing panel, the surround including a box portion made from metal and the perpendicular portion includes a non-metallic ledge that attaches to the box portion, the box portion having an elongated channel and the non-metallic ledge having an L-shaped cross-sectional shape, the ledge having an insertion leg capable of being received in the elongated channel and forming a portion of the L-shape, the ledge having a plateau at a base of the insertion leg that mates with a mating recess communicating with the channel to establish a given relative orientation.

16. An access structure for an opening through a building envelope, comprising:

a frame structure coupled to the building, framing the opening;

a spanning element spanning the frame structure, at least partially covering the opening, the spanning element having at least one panel and a surround embracing the periphery of the panel, the frame structure having a parallel portion extending parallel to the spanning element in a spanning direction and a perpendicular portion extending perpendicular to the spanning element relative to a spanning direction;

at least one of the perpendicular portion of the frame structure and the surround being a composite of a metal portion and a non-metal portion, the non-metal portion having a lower thermal conductivity than the metal portion, the non-metal portion being exposed to a first environment on a first side of the building envelope and the metal portion being proximate a second environment on a second side of the building envelope, the perpendicular portion of the frame having a connection bead that is capable of snap-fitting to an adaptor, the adaptor being non-metallic, the adaptor, when in place on the connection bead being proximate at least one seal extending from the surround when the spanning element at least partially covers the opening, the connection bead having a bifurcated arrowhead cross-sectional shape having a pair of opposed lead-in surfaces that interact with corresponding sloped surfaces on opposed arms of the adaptor, which define a hollow there between having a shape complementary to the connection bead, the arms resiliently displacing when pushed against the lead-in surfaces and snapping to a closed position when pushed beyond the lead-in surfaces.

17. The access structure of claim 16, wherein the arrowhead cross-sectional shape has a recess at the tip to receive sealant.

18. The access structure of claim 16, wherein the adaptor has a raceway distal to the opposed arms for receiving a trim cover.

19. A method for assembling a window for an opening through a building envelope, comprising:

obtaining a plurality of elongated frame elements made from aluminum alloy extrusions and having an attachment bead disposed on a surface thereof;

attaching the elongated frame elements together at the ends thereof to form a frame structure;

obtaining a plurality of polymer adaptors having a coupling head;

attaching the adaptors to corresponding ones of the frame elements by snap-fitting the coupling head over the attachment bead to form a frame assembly;

obtaining a plurality of elongated vent surround sections made from aluminum alloy extrusions;

attaching the plurality of elongated vent surround sections together at the ends thereof to form a vent surround;

obtaining a glazing panel;

inserting the glazing panel into the vent surround to form a vent assembly;

attaching the frame structure to the building, framing the opening; and attaching the vent assembly to the frame structure.

20. The method of claim 19, wherein the vent surround sections have an outward facing channel and further comprising the steps of obtaining a plurality of L-shaped ledge portions made from polymer and having insertion legs; and inserting the insertion legs of the ledge portions into corresponding channels of the vent surround sections.

* * * * *